US010050352B1

(12) United States Patent
Flores-Molina et al.

(10) Patent No.: US 10,050,352 B1
(45) Date of Patent: Aug. 14, 2018

(54) OMNIDIRECTIONAL PERIODICALLY-SPACED PHASED ARRAY USING ELECTROLYTIC FLUID ANTENNAS

(71) Applicant: SPAWAR Systems Center Pacific, San Diego, CA (US)

(72) Inventors: Carlos Flores-Molina, San Diego, CA (US); Kristopher R. Buchanan, San Diego, CA (US); Timi Adeyemi, San Diego, CA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/707,049

(22) Filed: Sep. 18, 2017

(51) Int. Cl.

| | |
|---|---|
| ***H01Q 1/32*** | (2006.01) |
| ***H01Q 21/06*** | (2006.01) |
| ***H01Q 1/28*** | (2006.01) |
| ***H01Q 3/26*** | (2006.01) |
| ***H01Q 21/20*** | (2006.01) |
| ***H01Q 21/00*** | (2006.01) |

(52) U.S. Cl.
CPC ..... *H01Q 21/062* (2013.01); *H01Q 1/286* (2013.01); *H01Q 3/26* (2013.01); *H01Q 21/0087* (2013.01); *H01Q 21/20* (2013.01)

(58) Field of Classification Search
CPC ..... H01Q 21/062
USPC ..... 343/713
See application file for complete search history.

(56) References Cited

U.S. PATENT DOCUMENTS 7,898,484 B1 3/2011 Tam et al.
7,969,370 B1 6/2011 Dinh et al.

OTHER PUBLICATIONS

Adeyemi, Timi et al.; Investigation and measurement of a sea water antenna array; Radio Science Meeting (USNC-URSI NRSM), 2017 United States National Committee of URSI National; Boulder, CO; Jan. 4-7, 2017.

I. Kocaman, "Distributed beamforming in a swarm UAV network," M.S. thesis, Dept Elect. Eng., Naval Postgraduate School, Monterey, CA, 2008.

A. Kaptan, "Net-Centric controlled distributed stand-in-jamming using DA Vs-transmission losses and range limitations due to geolocalization problem over Turkish geography," M.S. thesis, Dept. Elect. Eng., Naval Postgraduate School, Monterey, CA, (2012).

I. Tan and D. Pandya, "UAV digital tracking array design, development and testing," M.S. thesis, Dept. Elect Eng., Naval Postgraduate School, Monterey, CA, (2009).

D. Jenn, "Transmission Equation for Multiple Cooperative Transmitters and Collective Beamforming," IEEE Trans. Antennas and Wireless Propag., vol. 7, pp. 606-608. (2008).

G. H. Huff, J. F. Chamberland-Tremblay and J. Jensen, ; "Cognitive Motion-Dynamic Tethering of a Phased Array to an Android Smartphone," IEEE Trans. Antennas Propag., vol. 62, pp. 1093-1101. (2014).

(Continued)

*Primary Examiner* — Graham Smith
(74) *Attorney, Agent, or Firm* — SPAWAR Systems Center Pacific; Kyle Eppele; James Eric Anderson

(57) ABSTRACT

A phased array antenna comprising: a center conduit filled with electrolytic fluid; a current probe having a central hole therein, wherein the center conduit is disposed within the central hole; and two electrolytic fluid antennas positioned parallel to the center conduit and fluidically coupled to the electrolytic fluid in the center conduit so as to form a field-goal-shaped phased array antenna such that the current probe feeds the electrolytic fluid antennas through magnetic induction.

18 Claims, 10 Drawing Sheets

(56) References Cited

OTHER PUBLICATIONS

K. Buchanan and G. Huff; "A comparison of geometrically bound random arrays in Euclidean space," in IEEE Antennas and Propag. Soc. Int. Syrop., Spokane, WA, pp. 3-8. (2014 ).
K. Buchanan, "Theory and applications of aperiodic (random) phased arrays," Ph.D. dissertation, Dept. Elect. & Com. Eng., Texas A&M University, TX. (2014).
Y. Lo; "A mathematical theory of antenna arrays with randomly spaced elements," IEEE Trans. Antennas Propag., vol. 12, pp. 257-268. (1964 ).
Y. Lo, "A probabilistic approach to the design of large antenna arrays," IEEE Trans. Antennas Propag., vol. 11, pp. 95-96, Jan. 1963.
A. Panicali and L. Yuen, "A probabilistic approach to large circular and spherical arrays," IEEE Trans. Antennas Propag., vol. 17, pp. 514-522, Jul. 1969.
Y. Lo and R. Simcoe, "An experiment on antenna arrays with randomly spaced elements," IEEE Trans. Antennas Propag., vol. 15, pp. 231-235, Mar. 1967.
T. A. Dzekov and R. S. Berkowitz, "Parameters of a spherical random antenna array," Electronics Lett., vol. 14, pp. 195-496, Aug. 1978.
C. Hua, Z. Shen and J. Lu, "High-Efficiency Sea-Water Monopole Antenna for Maritime Wireless Communications," IEEE Trans. Antennas and Propag., vol. 62, pp. 5968-5973, Dec. 2014.
Y. Kosta, "Liquid antenna systems", in IEEE Antennas and Propagation Society Int. Symp., vol. 3, pp. 2392-2395.
K. Buchanan and G. Huff, "A stochastic mathematical framework for the analysis of spherically bound random arrays," IEEE Trans. Antennas Propag., vol. 62., pp. 3002-3011, Jun. 2014.

OMNIDIRECTIONAL PERIODICALLY-SPACED PHASED ARRAY USING ELECTROLYTIC FLUID ANTENNAS

FEDERALLY-SPONSORED RESEARCH AND DEVELOPMENT

The United States Government has ownership rights in this invention. Licensing and technical inquiries may be directed to the Office of Research and Technical Applications, Space and Naval Warfare Systems Center, Pacific, Code 72120, San Diego, Calif., 92152; voice (619) 553-5118; ssc_pac_t2@navy.mil. Reference Navy Case Number 104762.

BACKGROUND OF THE INVENTION

This invention relates to the field of phased array antennas. Typical phased arrays operate in environments where line of sight and secure communication is preferred. Spacing of half a wavelength is typically used amongst the elements spanning from a few elements to tens to hundreds or even thousands of elements. Essentially, periodic spacing between elements allow for progressive phase shifts in the feed (current) of each element in the array. Behavior in this manner results in radiation characteristics containing: a high gain/directive steerable main beam with low sidelobe levels. There is a need for an improved phased array antenna.

SUMMARY

Disclosed herein is a phased array antenna comprising: a center conduit, a current probe, and two electrolytic antennas. The center conduit is filled with electrolytic fluid. The current probe has a central hole and the center conduit is disposed within the central hole. The two electrolytic fluid antennas are positioned parallel to the center conduit and are fluidically coupled to the electrolytic fluid in the center conduit so as to form a field-goal-shaped phased array antenna. The current probe feeds the electrolytic fluid antennas through magnetic induction.

An embodiment of the phased array antenna may also be described as comprising: a center conduit, a current probe and first and second electrolytic fluid antenna elements. The center conduit is nonconductive, has upper and lower ends, is configured to contain an electrolytic fluid, and is disposed substantially parallel to a z-axis of an x-y-z mutually orthogonal axes coordinate system. The upper end of the center conduit in this embodiment terminates in a T-shaped coupler. The current probe comprises a core of ferromagnetic material having a central hole therein. The current probe is mounted between the upper and lower ends of the center conduit such that the center conduit is disposed within the central hole. Each electrolytic fluid antenna element comprises first and second sections. The first sections are coupled to opposite ends of the T-shaped coupler and comprise electrolytic fluid conduits that are substantially parallel to the x-axis. The second sections have lengths that are substantially parallel to the z-axis and are comprised of volumes of electrolytic fluid that are fluidically coupled to the electrolytic fluid in their respective first sections.

The phased array antenna described herein may be provided by performing the following steps. The first step provides for positioning a current probe having a toroidal-shaped core of ferromagnetic material around a nonconductive, electrolytic-fluid-filled center conduit that is disposed substantially parallel to a z-axis of an x-y-z mutually orthogonal axes coordinate system such that the center conduit is disposed within a central hole of the current probe's core, and such that the current probe is not in physical contact with the electrolytic fluid. The next step provides for fluidically coupling two columns of electrolytic fluid to the electrolytic fluid in the center conduit. The two columns of electrolytic fluid are substantially parallel to the z-axis and spaced apart from each other in the x-y plane by 0.5 wavelengths. The next step provides for connecting the current probe to a transceiver. The next step provides for feeding the columns of electrolytic fluid with the current probe via magnetic induction to create a phased array antenna.

BRIEF DESCRIPTION OF THE DRAWINGS

Throughout the several views, like elements are referenced using like references. The elements in the figures are not drawn to scale and some dimensions are exaggerated for clarity.

DETAILED DESCRIPTION OF EMBODIMENTS

Figure 1:
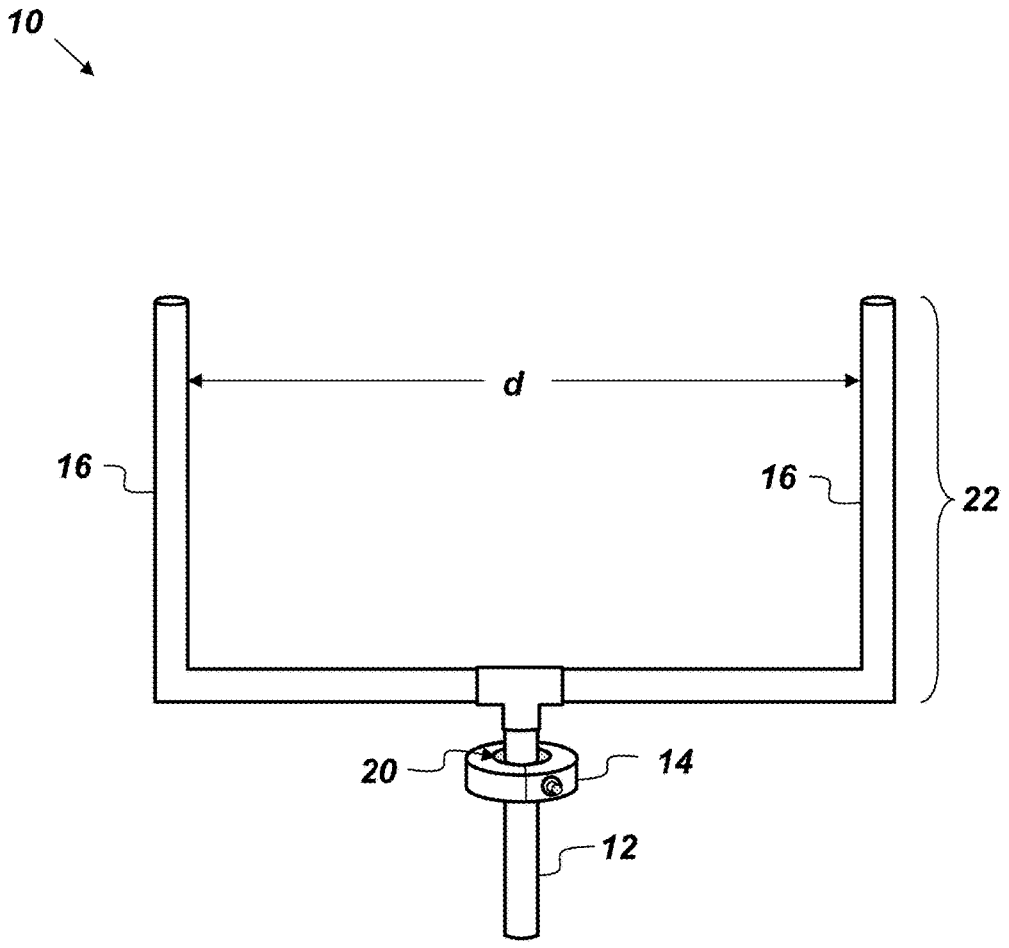
FIG. 1 is an illustration of an example embodiment of phased array antenna.

The disclosed antenna and method below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other methods and systems described herein as will be understood by one of ordinary skill in the art unless otherwise stated specifically.

Described herein is a phased array antenna 10 that comprises, consists of, or consists essentially of a center conduit 12, a current probe 14, and at least two electrolytic fluid antennas 16. The center conduit 12 is configured to be filled with electrolytic fluid 18 (Not shown in FIG. 1, but depicted in FIG. 2). The electrolytic fluid 18 may be any electrically-conducting solution. A suitable example of the electrolytic fluid 18 includes, but is not limited to, seawater, which has an average conductivity that is 5 Siemens per meter at 25° Celsius. It is to be understood that the electrolytic fluid 18 used with the phased array antenna 10 is not limited to seawater, but that seawater is just one embodiment of the electrolytic fluid 18. The center conduit 12 may be any non-conductive conduit capable of containing the electrolytic fluid 18. The electrolytic fluid antennas 16 are fluidically coupled to the electrolytic fluid 18 contained within the center conduit 12, and the electrolytic fluid antennas 16 have radiating portions that are parallel to each other. As used herein, fluids that are "fluidically coupled" means that the fluids are in physical contact with each other without barriers or membranes separating the fluids. The current probe 14 may be any device capable of feeding the electrolytic antennas 16 via magnetic induction without coming into physical contact with the electrolytic fluid 18. The current probe 14 has a shape that is topologically equivalent to a toroid having a central hole 20 therein. The center conduit 12 is disposed within the central hole 20. The current probe 14 may be any toroidal current transformer having a single coil and having any desired size and shape. A suitable example of the current probe 14 is the current injection device disclosed in U.S. Pat. No. 6,492,956 to Fischer et al., which is incorporated herein by reference. The current probe 14 may have a solid, ferromagnetic, toroidal core or the core may be split into two or more sections to allow it to be clamped around the center conduit 12 without cutting into or penetrating the center conduit 12.

FIG. 1 is an illustration of an example embodiment of phased array antenna 10. In the embodiment shown in FIG. 1, the phased array antenna 10 consists of two electrolytic antennas 16 each of which is comprised of a volume of static electrolytic fluid 18 held in L-shaped polyvinyl chloride (PVC) pipe. In this embodiment, the center conduit 12 is also comprised of PVC pipe. While PVC pipe is described herein, it is to be understood that PVC pipe is not the only material that may be used—the electrolytic antennas 16 may be held in any non-conductive tubing or may even be free-standing streams of electrolytic fluid. In the embodiment shown in FIG. 1, the two L-shaped PVC pipes housing the electrolytic antennas 16 are connected to the center conduit 12 via a T-shaped coupler so as to form a field-goal-shaped embodiment of the phased array antenna 10. The distance d between the upright sections 22 of the L-shaped pipes in this embodiment is equal to approximately ½ the center wavelength $f_0$ of the phased array antenna 10. As used herein, "approximately ½ of the center wavelength" means no greater than 0.55 and no less than 0.45 of the center wavelength. For example, if the center wavelength $f_0$ were 150 MHz, the distance d between the upright sections 22 would be approximately 1 meter (i.e., between 0.9 meters and 1.1 meters).

When the phased array antenna 10 is mounted on a semi perfect lossy earth, on a ship, and/or over a body of water, the electrolytic fluid antennas 16 are similar in operation to a traditional dipole antenna and similarly produce an equivalent omnidirectional radiation pattern. Each electrolytic fluid antenna 16 is an equivalent dipole (monopole over a ground plane) and, as a consequence, has an omnidirectional pattern. This type of pattern is useful for applications in phased array applications since it is capable of providing coverage in a 360 degree sector.

Figure 2:
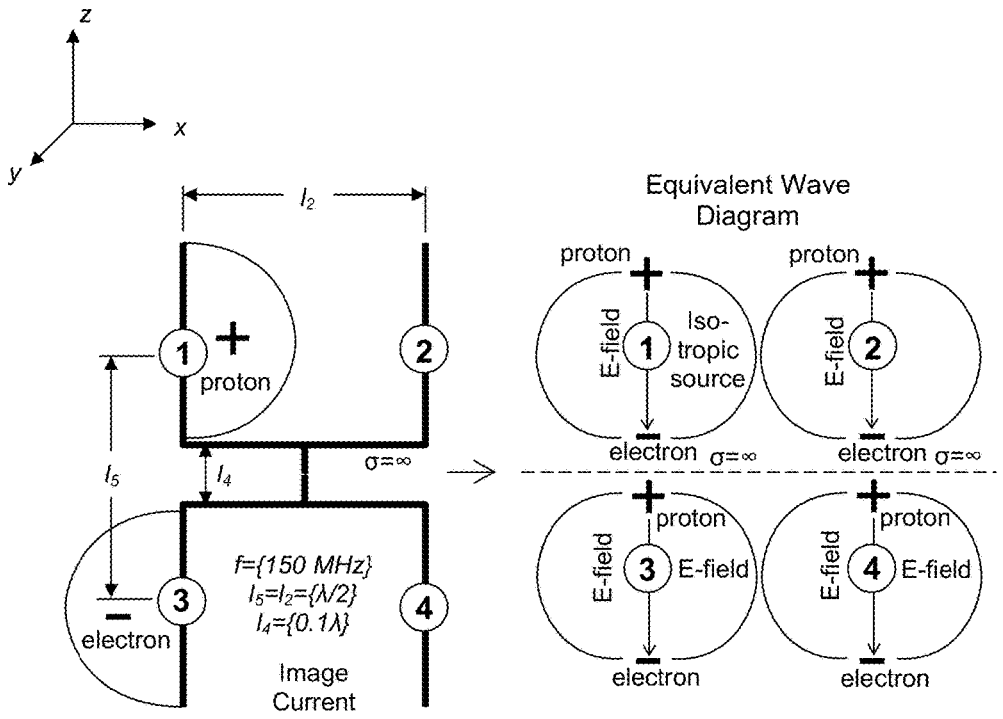
FIG. 2 is an illustration of an equivalent sum (Σ) beam circuit of an embodiment of a phased array antenna.

FIG. 2 is an illustration of an equivalent sum (Σ) beam circuit of the embodiment of the phased array antenna 10 shown in FIG. 1 mounted on a semi perfect lossy earth which results in the equivalent of a four-element array. Electrolytic fluid antennas provide a number of exclusive capabilities of which are not available in traditional antennas. These antennas provide low probability interception and low probability deception (LPI/LPD) capabilities by decreasing the antennas overall footprint in situations where real estate is scarce. For example, electrolytic fluid antennas can provide decoy capability and can disappear from the landscape when turned off. They eliminate the need for unsightly metallic antenna structures and reduce cost. They also provide multiband capabilities by being able to generate frequencies and bandwidths dependent upon overall height and width of the column of electrolytic fluid 18 in the electrolytic fluid antenna 16. Furthermore these electrolytic fluid antennas can be enhanced in a distributed or ad-hoc generated phased antenna array in order to provide greater performance capabilities. These include, but not limited to being able to generate multiple simultaneous beams by the means of digital-beam-forming (DBF) (multiple tracking); ultra-low sidelobes (−45 dB) and narrow beams (for low probability intercept LPI capability and minimal interference effects), pattern control and null positioning in the direction of noise jammers, adaptive beamwidth and data rate reconfiguration (for tracking purposes) and clutter suppression (or range degradation). The phased array 10 is multifunctional and may be used in many applications such as communications, data-links, radar (search and track), and electronic warfare (EW).

Figure 3A:
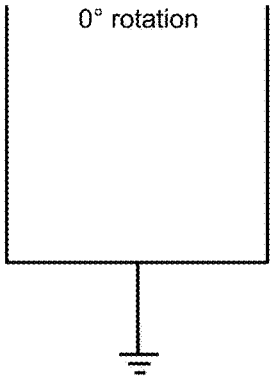
FIGS. 3A, 3B, and 3C depict various orientations of an embodiment of a phased array antenna.
Figure 3B:
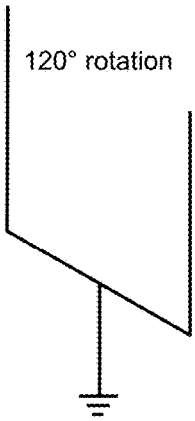
Figure 3C:
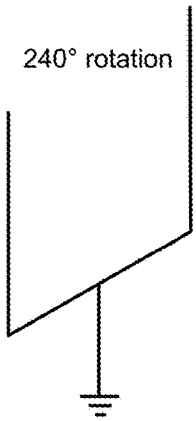
Figure 3D:
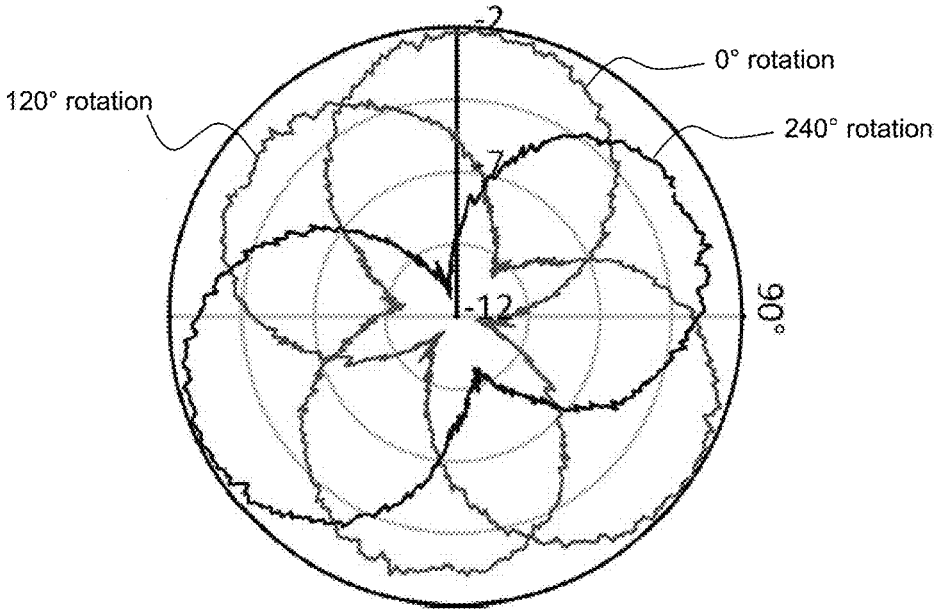
FIG. 3D is a plot of the measured antenna pattern of an embodiment of a phased array antenna.

FIGS. 3A, 3B, and 3C depict various orientations of the field-goal embodiment of the phased array antenna 10 as depicted in FIG. 1 as the uprights 22 are rotated about the axis of the center conduit 12. FIG. 3D is the measured antenna pattern of the field goal embodiment of the phased array antenna 10. The electrolytic fluid antenna 16 array position was positioned at 0° (see FIG. 3A), at 120° (see FIG. 3B), and at 240° (see FIG. 3C)(all positions relative to a boresight position of a receiving antenna) and excited for transmission. The radiation pattern shown in FIG. 3D was measured at each position (i.e., as depicted in FIGS. 3A, 3B, and 3C) and the results of the measurement show encouraging agreement with theoretical pattern behavior such as is described below.

To establish the basic technique of transmission lines, consider an electromagnetic wave of frequency fpropagating through a transmission line of length l with a velocity of v. The electromagnetic wave experiences a phase shift ϕ as follows:

$$\phi=2\pi fl/v \tag{1}$$

Therefore, a wave that propagates at constant velocity change can introduce a phase shift as seen in equation (1) by inducing a frequency or transmission line length change. In this manner, an electronic phase shift ψ may be generated. Since no phase shifting devices are required under the afore-mentioned conditions, there is no insertion loss due to phase shifters.

Figure 4A:
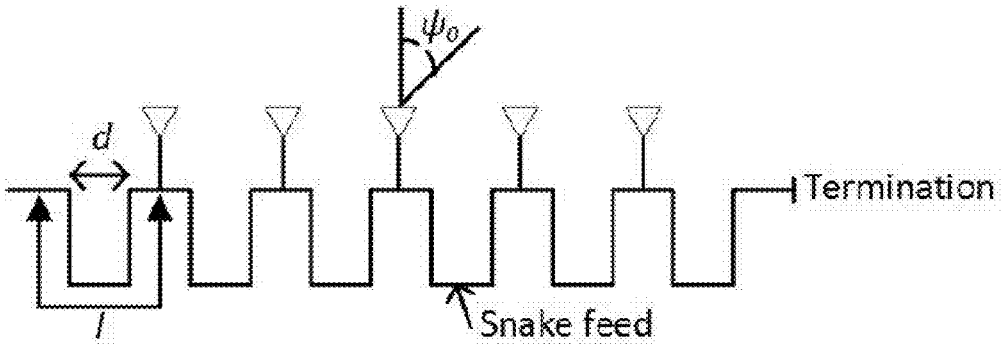
Fig. 4A PRIOR ART
FIG. 4A is an illustration of a traditional series feed arrangement for a phased array antenna.
Figure 4B:
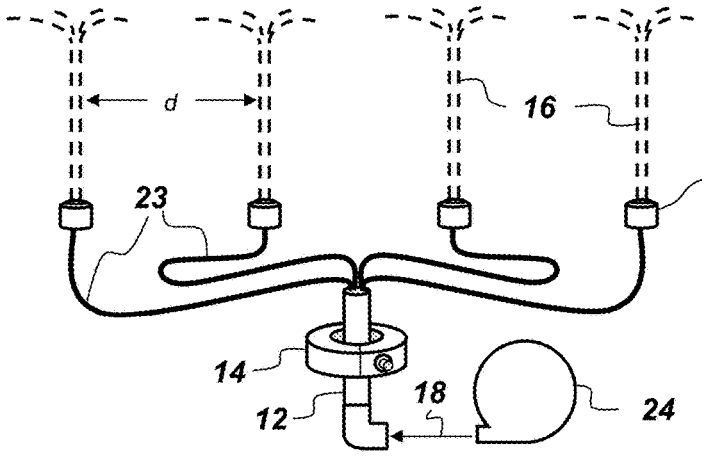
FIG. 4B is an illustration of an embodiment of a phased array antenna.

FIG. 4A is an illustration of a traditional series feed arrangement for a phased array antenna. FIG. 4B is an illustration of an embodiment of the phased array antenna 10 where various electrolytic fluid antennas 16 are connected to the center conduit 12 via lengths of hose/tubing/conduit 23, each connecting hose/tubing/conduit 23 having a specified length. If the beam is to point in a direction $\theta_0$, the phase difference between elements should be $\sin kd\theta_0$, where d is the spacing between each antenna element and where k is the wavenumber $2\pi f$. In scanned arrays, usually an integral number of $2\pi$ radians is added. This permits a scan angle to be obtained with a smaller frequency change. Equating phase difference to phase shift obtained from a line/hose of length l gives:

$$\frac{2\pi d\sin\theta_0}{\lambda + 2\pi m} = \frac{2\pi l}{\lambda} \tag{2}$$

$$\sin\theta_0 = -\frac{m\lambda}{d} + \frac{l}{d} \tag{3}$$

Where m is an integer number and A is the wavelength. When $\theta_0=0°$, which corresponds to the broadside beam direction, equation (3) results in $m=l/\lambda_0$, where $\lambda_0$ corresponds to the wavelength and $f_0$ is the center frequency at the broadside direction.

Figure 5A:
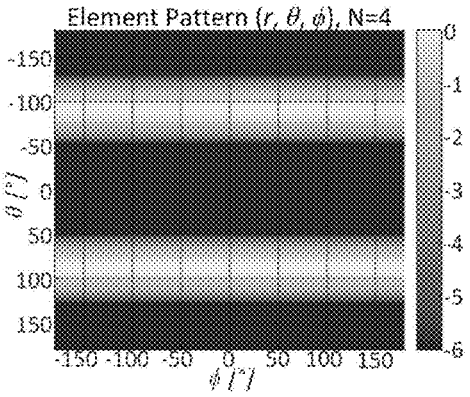
FIG. 5A shows the element pattern for a four-element array in spherical coordinates.
Figure 5B:
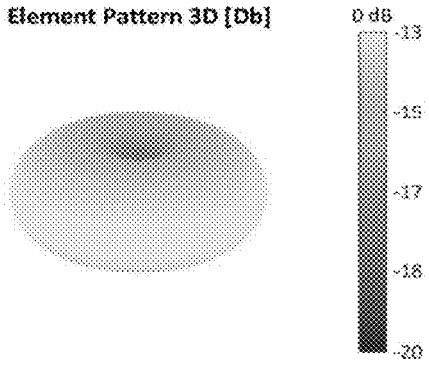
FIG. 5B shows the element pattern for a four-element array in Cartesian coordinates.
Figure 6A:
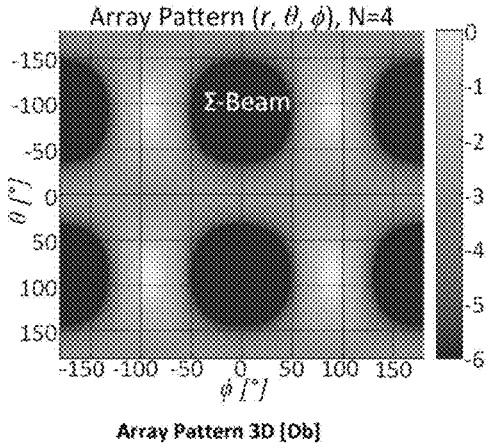
FIG. 6A is a plot of the total pattern of a theoretical four-element array in a spherical (r, θ, ϕ) coordinate system.
Figure 6B:
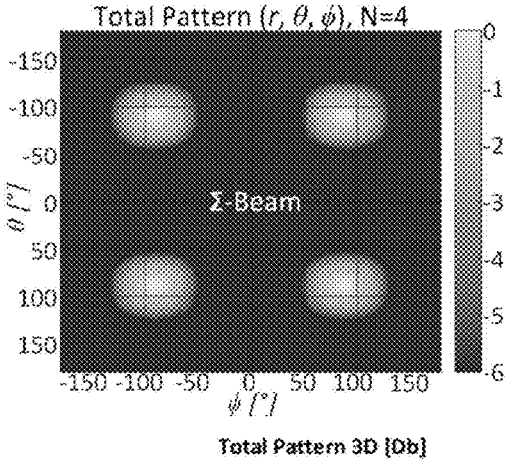
FIG. 6B is a plot of the array pattern of a theoretical four-element array in a spherical (r, θ, ϕ) coordinate system.
Figure 6C:
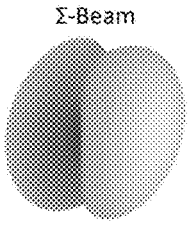
FIG. 6C is a plot of the total pattern of a theoretical four-element array in a Cartesian (x, y, z) coordinate system.
Figure 6D:
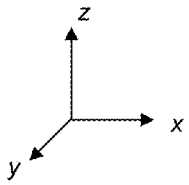
FIG. 6D is a plot of the array pattern of a theoretical four-element array in a Cartesian (x, y, z) coordinate system.
Figure 6D:
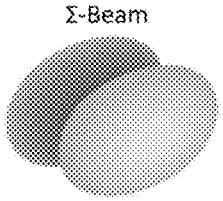

In theory, the array factor $AF_{\Sigma\text{-}beam}$ for a four-element array in sum mode $AF_{\Sigma\text{-}beam}$ is provided by the equation (5) below:

$$AF_{\Sigma-beam} = \sum_{n=1}^{4} e^{jk(\hat{r}\cdot\hat{r}_n)} = \begin{pmatrix} e^{jk(d_x \sin\theta\cos\phi + d_z\cos\theta)} + e^{-jk(d_x \sin\theta\cos\phi + d_z\cos\theta)} \\ e^{jk(d_x \sin\theta\cos\phi - d_z\cos\theta)} + e^{-jk(d_x \sin\theta\cos\phi - d_z\cos\theta)} \end{pmatrix} = 4\cos(d_x\sin\theta\cos\phi + d_z\cos\theta)\cos(d_x\sin\theta\cos\phi - d_z\cos\theta) \tag{5}$$

Where k is the wave number and $d_x$ and $d_z$ represent the spacing between elements in an x and z axis respectively. FIGS. 5A and 5B show the element pattern for a four-element array in spherical and Cartesian coordinates. Illustrations of the array pattern of the theoretical four-element array are shown in FIGS. 6A and 6C. Illustrations of the total pattern of the theoretical four-element array are shown in FIGS. 6B and 6D. The theoretical four-element array is an equivalent model for the field-goal-shaped embodiment of the phased array antenna 10 when placed over a lossy earth or ground plane. In FIGS. 6A-6D the sum beam was steered to $\theta_0=\phi_0=90$. FIGS. 6A and 6B are respectively representations of the total pattern and the array of the theoretical four-element array in a spherical (r, θ, ϕ) coordinate system. FIGS. 6C and 6D are respectively representations of the total pattern and the array of the theoretical four-element array in a Cartesian (x, y, z) coordinate system.

Figure 7:
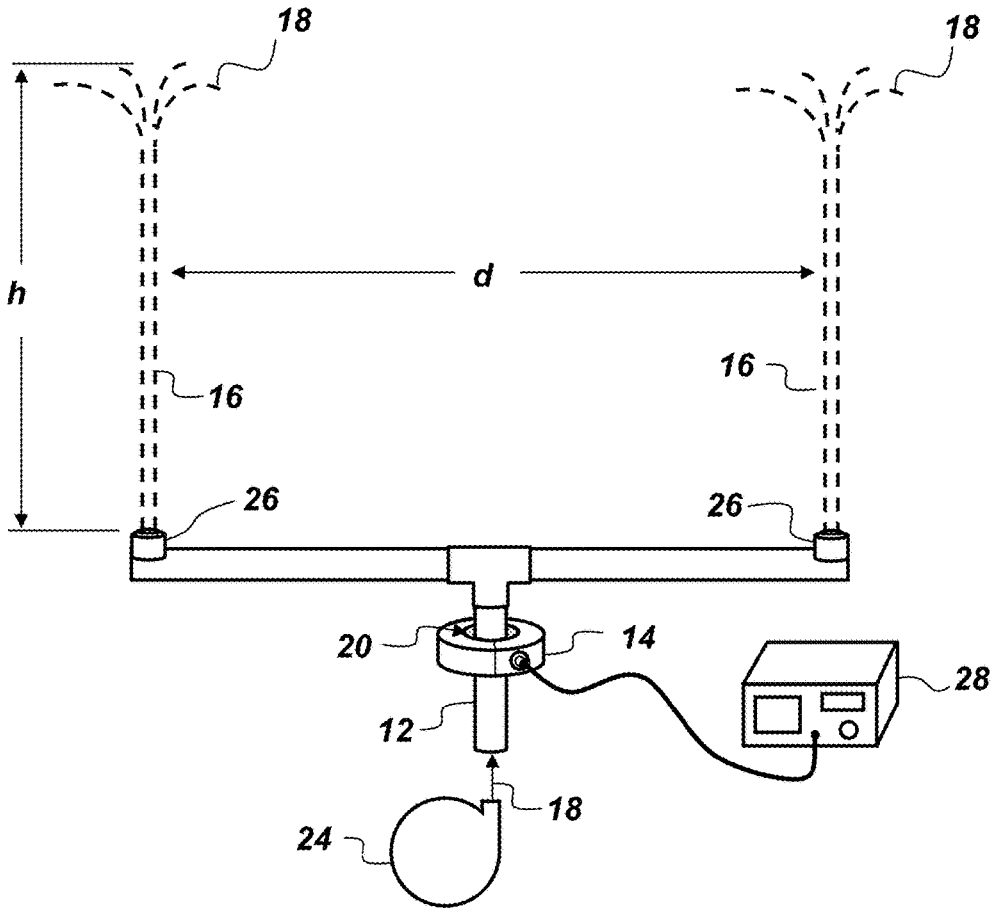
FIG. 7 is an illustration of an embodiment of a phased array antenna.

FIG. 7 is an illustration of an embodiment of the phased array antenna 10 where each of the electrolytic fluid antennas 16 comprises a free-standing stream of electrolytic fluid 18. The height h of the free-standing streams of electrolytic fluid 18 may be changed in real time by adjusting the pressure of the electrolytic fluid in the center conduit 12 thereby altering the operating frequency of the phased array antenna 10. In this embodiment, the electrolytic fluid 18 is pumped into the center conduit 12 by a pump assembly 24. The bandwidth of the electrolytic fluid antennas 16 may be increased by increasing the diameter of the stream of electrolytic fluid 18 exiting nozzles 26. The current probe 14 may be connected to any desired transmitter, receiver, or transceiver. In FIG. 7, the current probe 14 is shown as being connected to a transceiver 28.

In an embodiment of the phased array antenna 10, steerable directive patterns may be constructed from an assortment of identical electrolytic fluid antennas 16 fed with an equal amount of power for the elements in addition to an appropriate progressive phase shift. This may be expanded to applications requiring wide bandwidths. For example, an embodiment of the phased array antenna 10 may comprise a plurality of electrolytic fluid antenna elements arranged in a concentric ring configuration using multiple jet spray heads such as the nozzles 26. In this fashion the electrolytic fluid antennas 16 are selected to operate based upon the frequency of operation of the phased array antenna 10 such that the operating elements are determined in a fashion that maintains the lambda over two spacing between elements.

Figure 8:
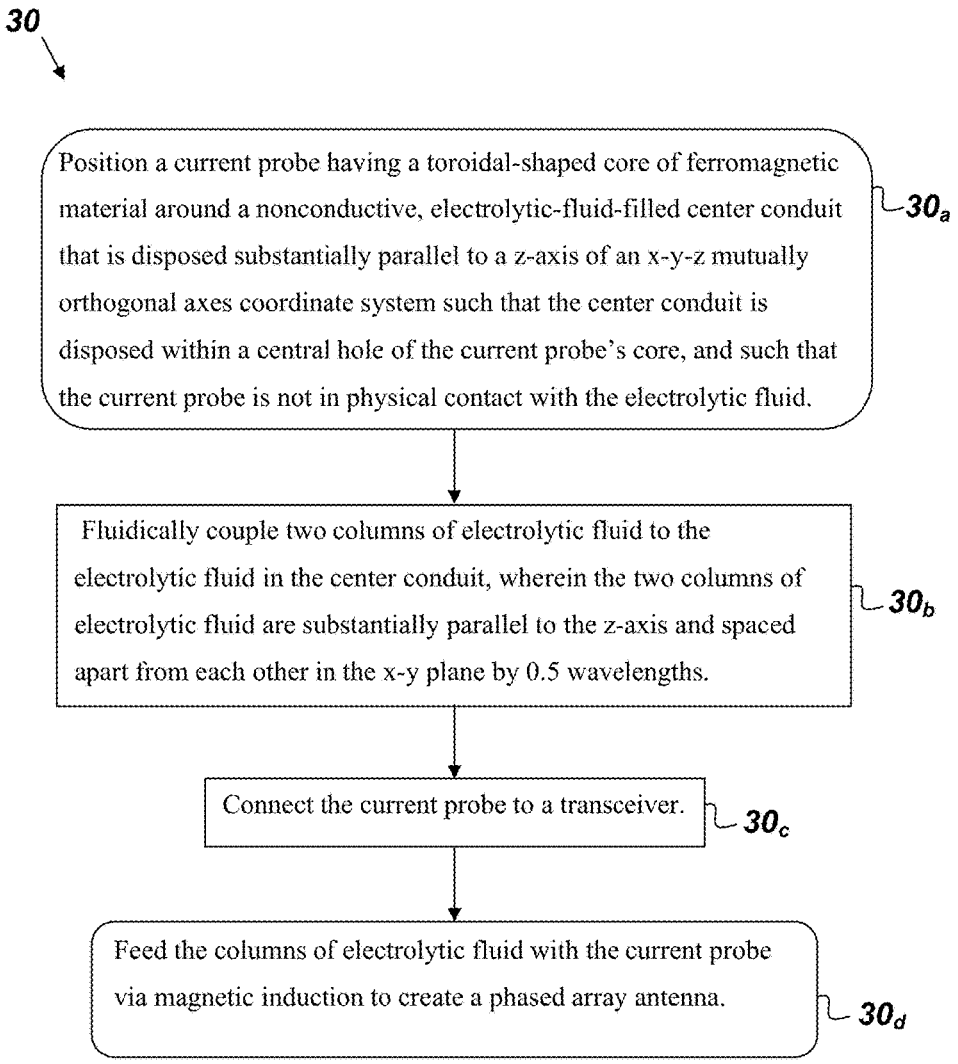
FIG. 8 is a flowchart of a method for providing a phased array antenna.

FIG. 8 is a flowchart of a method 30 for providing the phased array antenna 10 that comprises the following steps. The first step $\mathbf{30}_a$ provides for positioning a current probe having a toroidal-shaped core of ferromagnetic material around a nonconductive, electrolytic-fluid-filled center conduit that is disposed substantially parallel to a z-axis of an x-y-z mutually orthogonal axes coordinate system such that the center conduit is disposed within a central hole of the current probe's core, and such that the current probe is not in physical contact with the electrolytic fluid. The next step $\mathbf{30}_b$ provides for fluidically coupling two columns of electrolytic fluid to the electrolytic fluid in the center conduit, wherein the two columns of electrolytic fluid are substantially parallel to the z-axis and spaced apart from each other in the x-y plane by 0.5 wavelengths. The next step $\mathbf{30}_c$ provides for connecting the current probe to a transceiver. The next step $\mathbf{30}_d$ provides for feeding the columns of electrolytic fluid with the current probe via magnetic induction to create a phased array antenna. Multiple simultaneous beams may be generated by means of digital-beam-forming.

Figure 9A:
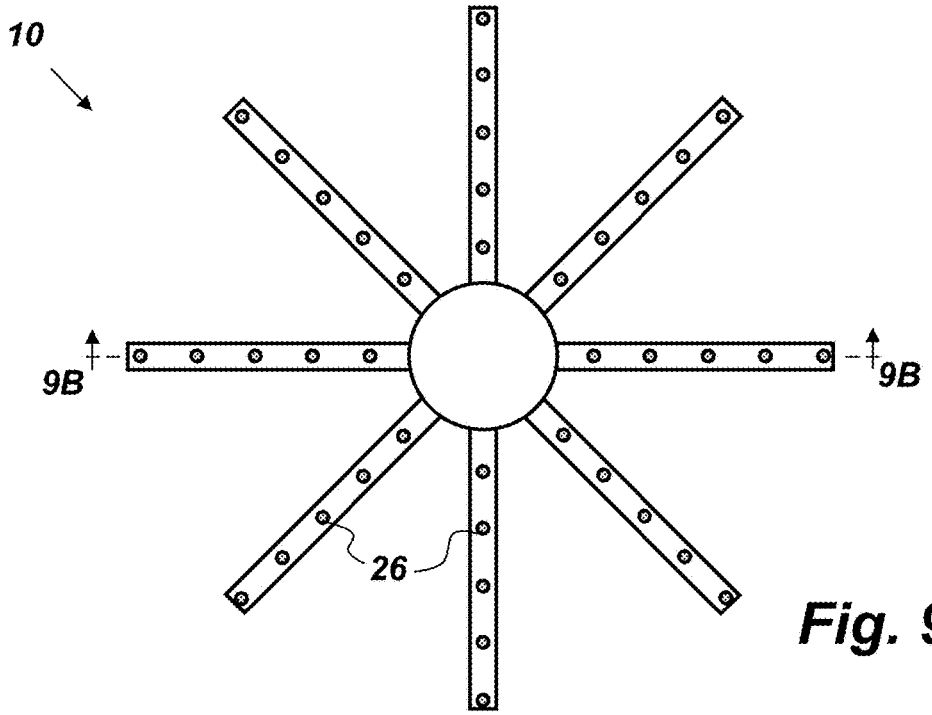
FIG. 9A is a top view illustration of an embodiment of a phased array antenna.
Figure 9B:
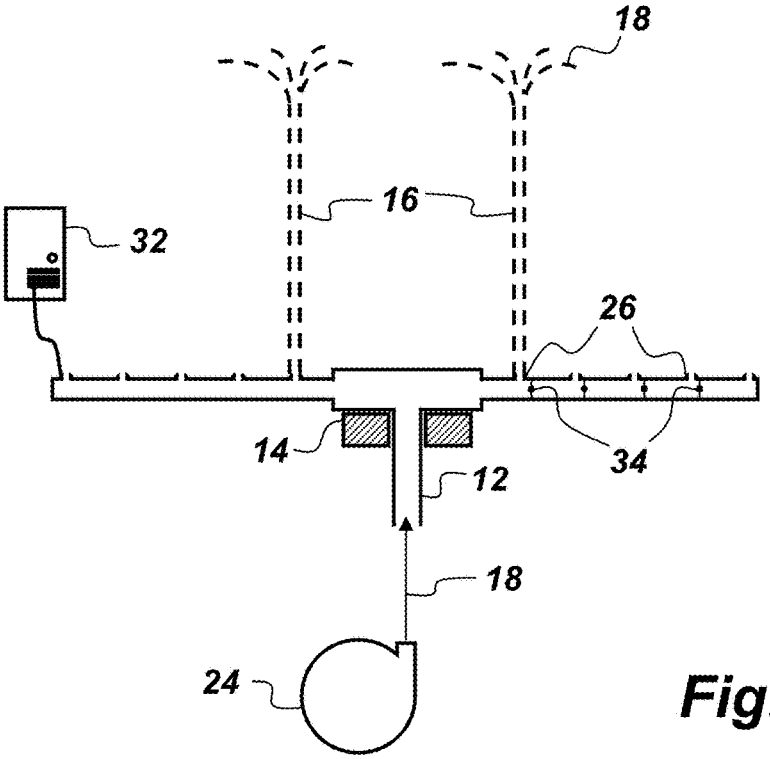
FIG. 9B is a cross-sectional, side view illustration of an embodiment of a phased array antenna.

FIGS. 9A and 9B are respectively top view and cross-sectional, side view illustrations of an embodiment of the phased array antenna 10. In this embodiment, the phased array antenna 10 comprises a plurality of nozzles 26 arranged in a concentric rings formation. As pressurized electrolytic fluid 18 exits the nozzles 26, it forms at least two electrolytic fluid antennas 16 as shown in FIG. 9B. The operating frequency of the phased array antenna 10 may be changed dynamically and in real time by opening a given set of nozzles and closing the others. In another embodiment, all the nozzles may be opened simultaneously. The distance between the nozzles in FIGS. 9A and 9B are not drawn to scale. Also note, the phased array antenna 10 is not limited to the number of nozzles 26 depicted in FIGS. 9A and 9B but may have any desired number of nozzles 26. The nozzles 26 may optionally be computer controlled such that they may be opened or closed in real time to change the characteristics of the phased array antenna 10. In FIG. 9B, one of the nozzles 26 is shown as being communicatively coupled to a computer 32. The phased array antenna 10 may also comprise optional internal valves 34 configured to control the flow of electrolytic fluid 18 to the various nozzles 26. The internal valves 34 may be computer-controlled.

Figure 10A:
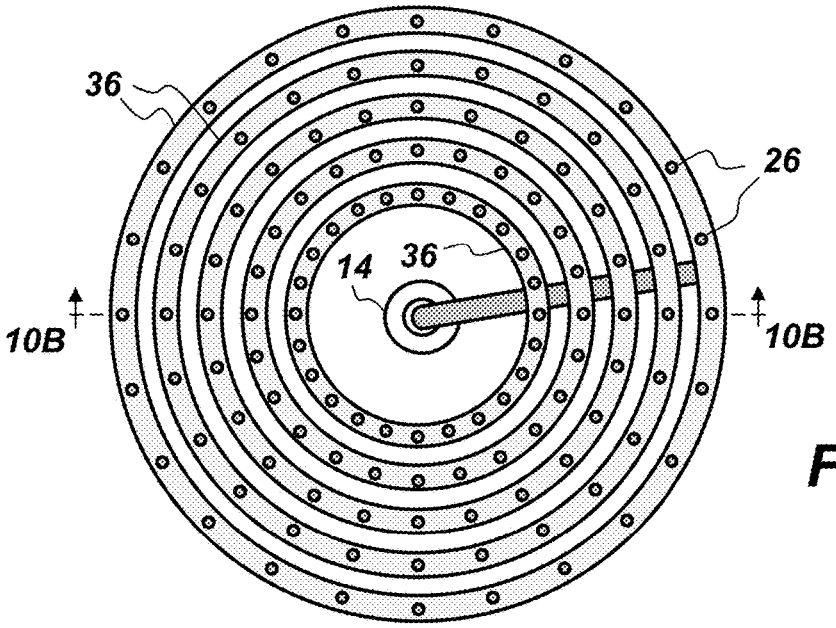
FIG. 10A is a top view illustration of an embodiment of a phased array antenna.
Figure 10B:
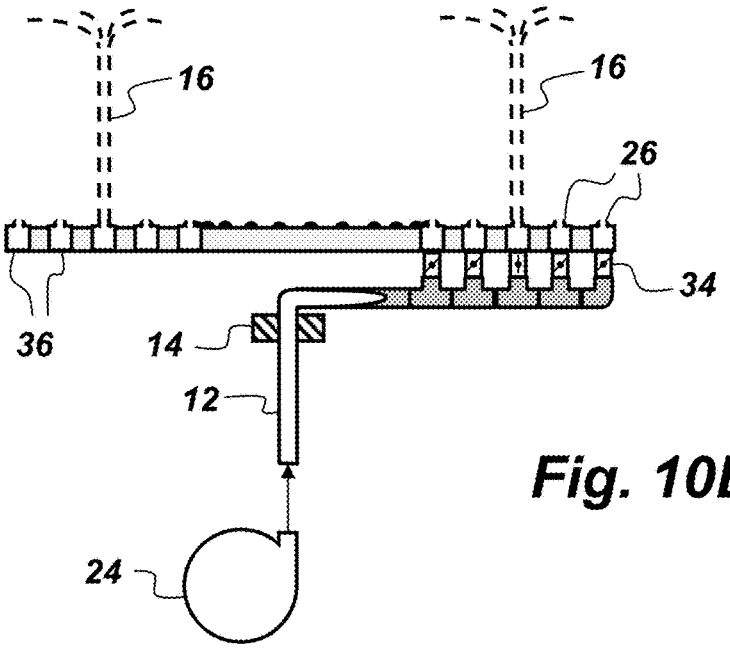
FIG. 10B is a cross-sectional, side view illustration of an embodiment of a phased array antenna.

FIGS. 10A and 10B are respectively top view and cross-sectional, side view illustrations of an embodiment of the phased array antenna 10. This embodiment of the phased array antenna 10 comprises a plurality of nozzles 26 arranged in a concentric rings formation where each ring 36 is a fluid channel connected to the center conduit 12 via a corresponding internal valve 34. When one of the internal valves 34 is opened it allows pressurized electrolytic fluid 18 to exit the nozzles 26 in the corresponding ring. As with other embodiments, the internal valves 34 may be computer controlled to allow dynamic, real-time adjustment of the characteristics of the phased array antenna 10. In lieu of the internal valves 34, computer-controlled nozzles 26 may be used to alter the characteristics of the phased array antenna 10.

From the above description of the phased array antenna 10, it is manifest that various techniques may be used for implementing the concepts of the phased array antenna 10 without departing from the scope of the claims. The described embodiments are to be considered in all respects as illustrative and not restrictive. The method/apparatus disclosed herein may be practiced in the absence of any element that is not specifically claimed and/or disclosed herein. It should also be understood that the phased array antenna 10 is not limited to the particular embodiments described herein, but is capable of many embodiments without departing from the scope of the claims.

We claim:

1. A phased array antenna comprising:

a center conduit filled with electrolytic fluid;

a current probe having a central hole therein, wherein the center conduit is disposed within the central hole; and two electrolytic fluid antennas positioned parallel to the center conduit and fluidically coupled to the electrolytic fluid in the center conduit so as to form a field-goal-shaped phased array antenna such that the current probe feeds the electrolytic fluid antennas through magnetic induction.

2. The phased array antenna of claim 1, wherein the two electrolytic fluid monopole antennas comprise L-shaped, nonconductive tubing filled with static electrolytic fluid.

3. The phased array antenna of claim 1, further comprising a pump configured to pump the electrolytic fluid through the center conduit and wherein uprights of the field-goal-shaped phased array antenna are composed only of free-standing streams of the electrolytic fluid.

4. The phased array antenna of claim 3, wherein the uprights are spaced apart by approximately 0.5 wavelengths.

5. The phased array antenna of claim 1, further comprising a plurality of electrolytic fluid monopole antennas fluidically coupled to the center conduit so as to form a concentric ring configuration.

6. A phased array antenna comprising:

a center conduit that is nonconductive, has upper and lower ends, is configured to contain an electrolytic fluid, and is disposed substantially parallel to a z-axis of an x-y-z mutually orthogonal axes coordinate system, wherein the upper end terminates in a T-shaped coupler;

a current probe comprising a core of ferromagnetic material having a central hole therein, wherein the current probe is mounted between the upper and lower ends of the center conduit such that the center conduit is disposed within the central hole; and first and second electrolytic fluid antenna elements, wherein each electrolytic fluid antenna element comprises first and second sections, wherein the first sections are coupled to opposite ends of the T-shaped coupler and comprise electrolytic fluid conduits that are filled with electrolytic fluid and are substantially parallel to the x-axis, and wherein the second sections have lengths that are substantially parallel to the z-axis and are comprised of volumes of electrolytic fluid that are fluidically coupled to the electrolytic fluid in their respective first sections.

7. The phased array antenna of claim 6, wherein the second sections comprise nonconductive tubing filled with static electrolytic fluid.

8. The phased array antenna of claim 6, further comprising a pump configured to pump the electrolytic fluid through the center conduit and wherein the second sections are composed only of free-standing streams of the electrolytic fluid.

9. The phased array antenna of claim 6, wherein the uprights are spaced apart by approximately 0.5 wavelengths.

10. A method for providing a phased array antenna comprising:

positioning a current probe having a toroidal-shaped core of ferromagnetic material around a nonconductive, electrolytic-fluid-filled center conduit that is disposed substantially parallel to a z-axis of an x-y-z mutually orthogonal axes coordinate system such that the center conduit is disposed within a central hole of the current probe's core, and such that the current probe is not in physical contact with the electrolytic fluid;

fluidically coupling two columns of electrolytic fluid to the electrolytic fluid in the center conduit, wherein the two columns of electrolytic fluid are substantially parallel to the z-axis and spaced apart from each other in the x-y plane by 0.5 wavelengths;

connecting the current probe to a transceiver; and feeding the columns of electrolytic fluid with the current probe via magnetic induction to create a phased array antenna.

11. The method of claim 10, further comprising containing the two columns of electrolytic fluid in nonconductive tubing.

12. The method of claim 10, further comprising the step of pumping the electrolytic fluid through the center conduit and out nozzles such that the two columns of electrolytic fluid are composed only of free-standing streams of the electrolytic fluid.

13. The method of claim 10, further comprising fluidically coupling a plurality of columns of electrolytic fluid to the electrolytic fluid in the center conduit, wherein the plurality of columns of electrolytic fluid are substantially parallel to the z-axis and spaced apart from each other in the x-y plane by 0.5 wavelengths.

14. The method of claim 13, further comprising positioning the plurality of columns of electrolytic fluid in a concentric ring configuration about the center conduit.

15. The method of claim 10 further comprising the step of varying the columns' heights in real time to vary a frequency of operation of the phased array antenna.

16. The method of claim 10 further comprising the step of varying the columns' width in real time to vary a bandwidth of the phased array antenna.

17. The method of claim 10 further comprising the step of generating multiple simultaneous beams by means of digital-beam-forming.

18. The method of claim 12, wherein the electrolytic fluid is seawater.

* * * * *